US006945533B1

(12) United States Patent
Salerno

(10) Patent No.: US 6,945,533 B1
(45) Date of Patent: Sep. 20, 2005

(54) GAMING CLOTH AND DEVICE FOR SECURING CLOTH TO GAMING TABLE

(76) Inventor: James M. Salerno, 2920 Via LaSelva, Palos Verdes Estates, CA (US) 90274

( * ) Notice: Subject to any disclaimer, the term of this patent is extended or adjusted under 35 U.S.C. 154(b) by 486 days.

(21) Appl. No.: 09/715,216

(22) Filed: Nov. 17, 2000

(51) Int. Cl.[7] ..... A63F 9/00

(52) U.S. Cl. ..... 273/309; 428/80; 428/100; 160/330

(58) Field of Search ..... 273/309, 246, 273/262, 264, 267, 270, 294.1, 301; 26/93; 135/119; 473/30

(56) References Cited

U.S. PATENT DOCUMENTS

| | | | | | |
|---|---|---|---|---|---|
| 864,292 | A | * | 8/1907 | Cohen | 473/30 |
| 1,003,880 | A | * | 9/1911 | Crechriou | 473/30 |
| 1,036,238 | A | * | 8/1912 | Hjort | 473/30 |
| 1,535,895 | A | * | 4/1925 | Blackmore | 273/309 |
| 1,579,730 | A | * | 4/1926 | Nelson | 473/30 |
| 1,926,429 | A | * | 9/1933 | Bendelari | 108/90 |
| 3,279,515 | A | * | 10/1966 | Kesh | 108/90 |
| 3,295,577 | A | * | 1/1967 | Danielson | 108/90 |
| 3,389,044 | A | * | 6/1968 | Loomis | 442/59 |
| 3,683,427 | A | * | 8/1972 | Burkholz et al. | 4/499 |
| 4,223,056 | A | * | 9/1980 | Di Fronzo | 428/52 |
| 4,648,159 | A | * | 3/1987 | Dougherty | 24/117 |
| 4,705,084 | A | * | 11/1987 | Rodebaugh et al. | 150/52 R |
| 4,708,183 | A | * | 11/1987 | Figueroa | 150/52 R |
| 4,742,602 | A | * | 5/1988 | Horner | 24/115 K |
| 4,954,384 | A | * | 9/1990 | Hartwell | 428/100 |
| 4,991,242 | A | * | 2/1991 | Brown | 5/60 |
| 5,060,712 | A | * | 10/1991 | Ehrlich | 160/330 |
| 5,084,321 | A | * | 1/1992 | Sui | 428/80 |
| 5,203,055 | A | * | 4/1993 | Broadwater, Sr. | 24/462 |
| 5,331,993 | A | * | 7/1994 | Billbury | 135/119 |
| 5,346,209 | A | * | 9/1994 | Kring | 473/32 |
| 5,441,789 | A | * | 8/1995 | Walker | 428/78 |
| 5,568,666 | A | * | 10/1996 | Seibert | 8/149.1 |
| 5,586,766 | A | * | 12/1996 | Forte et al. | 273/309 |
| 5,615,699 | A | * | 4/1997 | Lee | 135/118 |
| 5,662,133 | A | * | 9/1997 | Guido, Jr. | 135/119 |
| 5,707,032 | A | * | 1/1998 | Ehrlich | 248/205.3 |
| 5,778,802 | A | * | 7/1998 | Hairston et al. | 108/90 |
| 5,960,520 | A | * | 10/1999 | Conway et al. | 24/306 |
| 5,971,861 | A | * | 10/1999 | Wright | 473/14 |
| 6,074,720 | A | * | 6/2000 | Van Stratum | 428/41.4 |
| 6,131,864 | A | * | 10/2000 | Schumann | 248/205.3 |
| 6,187,404 | B1 | * | 2/2001 | Schumann | 428/40.1 |
| 6,220,598 | B1 | * | 4/2001 | Kweitko et al. | 273/309 |
| 6,240,855 | B1 | * | 6/2001 | Pirkl et al. | 108/115 |
| 6,286,834 | B1 | * | 9/2001 | Caputo | 273/274 |
| 6,306,477 | B1 | * | 10/2001 | Pacione | 428/62 |

* cited by examiner

*Primary Examiner*—Derris H. Banks
*Assistant Examiner*—Dolores R. Collins
(74) *Attorney, Agent, or Firm*—Irving Keschner

(57) ABSTRACT

A system for securing a gaming cloth to a gaming table of various shapes and sizes. In one embodiment, a Velcro loop strip is attached to the bottom surface of flaps which form the border of the cloth. A continuous Velcro hoop strip is positioned around the table perimeter. The gaming cloth is securely attached to the table by positioning the cloth over the table and stretching the cloth until the loop containing flap portions engage the hooks on the table hook strip. In a second embodiment, a continuous metal hook strip is mounted around the circumference, or perimeter, of the table. The gaming cloth is securely attached to the table by positioning the cloth over the table and stretching the cloth until the loop containing flaps engage the hooks on the table metal hook strip.

4 Claims, 2 Drawing Sheets

GAMING CLOTH AND DEVICE FOR SECURING CLOTH TO GAMING TABLE

BACKGROUND OF THE INVENTION

1. Field of the Invention

The present invention provides a gaming cloth and devices for securing the cloth to a gaming table.

2. Description of the Prior Art

Conventional gaming tables are typically overlaid with a cloth cover having the gaming symbols formed on the top surface thereof. For example, a roulette gaming table cloth will have the wheel numbers formed on the cloth surface enabling the players to place bets on the symbol corresponding to the selected wheel number.

The cloth covers currently in use are attached to the table surfaces by stapling the cover edges to the sides of the table, (alternately, drawstrings may be used for securing the cloth to round tables).

Due to the extensive use of the table, the cloth cover tends to wear out over a period of time. The table cloth thus must be replaced which requires workers to first spend time in removing the staples, removing the cloth, fitting the new cloth over the table and then stapling the cloth edges to the table sides. The time and labor involved in removing and then replacing the cloth covers is a significant cost to the casino owners.

What is thus desired is to provide a gaming table cloth which is attached to a gaming table in a manner where it can be easily and quickly replaced when necessary.

SUMMARY OF THE INVENTION

The present invention provides apparatus for securing a gaming cloth to a table of various shapes and sizes. In one embodiment, a Velcro® loop strip is attached to the underside, or border formed around the edges of the cloth. In one embodiment, a continuous metal hook strip is mounted along the circumference, or perimeter, of the table. The gaming cloth is securely attached to the table by positioning the cloth over the table and then stretching the cloth until the loop containing flaps engage the hooks on the hook strip formed on the table. In a second embodiment, a continuous Velcro® hook strip is mounted along the circumference, or perimeter, of the table. The gaming cloth is securely attached to the table by positioning the cloth over the table and stretching the cloth until the loop containing border engage the hooks on the Velcro hook strip formed on the perimeter of the table.

The present invention thus provides a simple technique for removably securing a gaming cloth to a table, providing significant savings in cost as a result.

DESCRIPTION OF THE DRAWING

For better understanding of the present invention as well as other objects and further features thereof, reference is made to the following description which is to be read in conjunction with the accompanying drawing therein.

DESCRIPTION OF THE INVENTION

Figure 1:
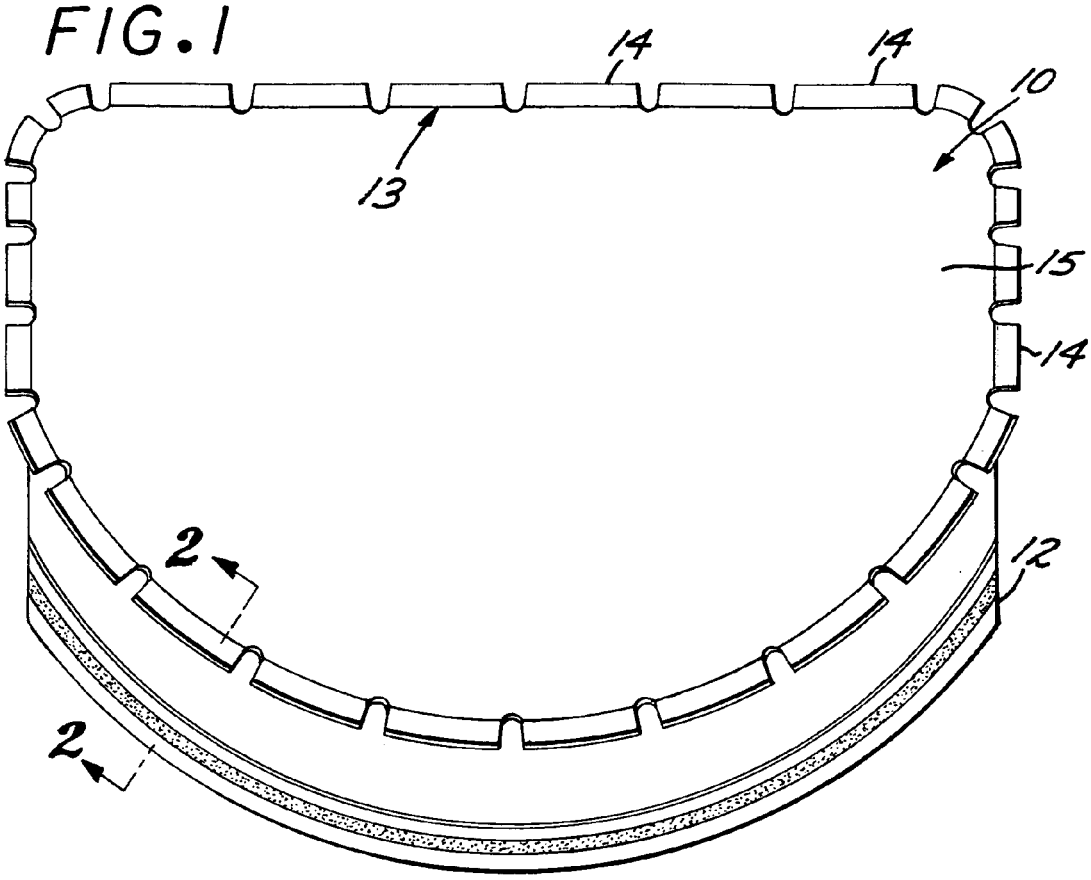
FIG. 1 is a perspective view of the gaming cloth and table utilized in the present invention.

Referring now to FIG. 1, a perspective view of the gaming cloth 10 of the present invention positioned above gaming table 12 is illustated. Cloth 10 is made of fabric, preferably polyester or Cordura® nylon, and includes a border portion 13 which extends about the circumference, or perimeter of the cloth as illustrated. The border 13 may comprise a series of flap portions 14 as illustrated although a continuous border portion can be utilized. It should be noted that although cloth 10 has the shape illustrated, the cloth can be formed to fit any table shape and size. Surface 15 of cloth 10 has symbols printed thereon (not shown) which represent gambling type games, such as 21 (or blackjack) and roulette.

Figure 2:
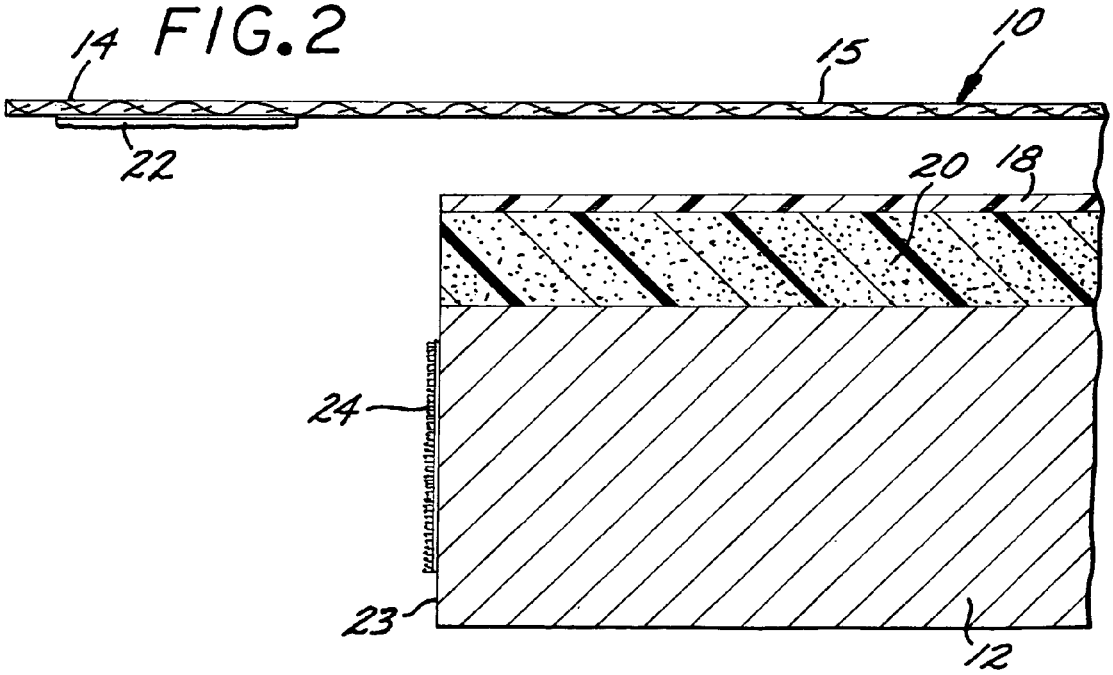
FIG. 2 is a cross-sectional view along line 2—2 of FIG. 1.

As illustated in FIG. 2, gaming table 12 is conventional and typically comprises a textile covering 18, a waterproof membrane (not shown), a foam rubber layer 20 positioned on the table surface in a conventional manner and a portion 23 which extends downwardly from and substantially perpendicular to, the table surface and extending around the circumference, or perimeter, of the table. In accordance with the teachings of the present invention, a fastening member, such as Velcro comprising a plurality of loop members 22, is secured, typically by adhesive, to the bottom surface of a flap portion 14 (although not illustrated, each flap portion 14 has a similar Velcro loop member secured to its bottom surface). The circumferential portion 23 of table 12 has a corresponding fastener member, such as Velcro loop strip 24, formed therearound as illustrated.

Figure 3:
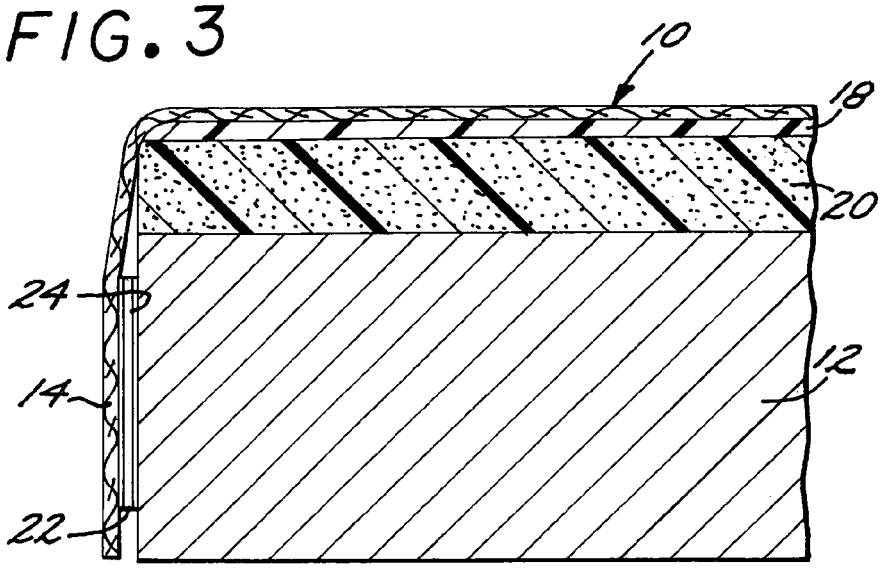
FIG. 3 is a cross-sectional view similar to FIG. 2 with the gaming cloth secured to the table utilizing a Velcro system.

FIG. 3 illustrates cloth 10 releaseably joined to table 12. This is accomplished by placing cloth 10 on the surface of table 12 and then stretching cloth 10 until the loop members 22 formed on the bottom surface of flap portions 14 engage hook strip 24, in a manner such that the printed image on surface 15 precisely fits over the top surface of table 12. The use of a Velcro hoop/loop fastener configuration for joining two items together is well known.

Figure 4:
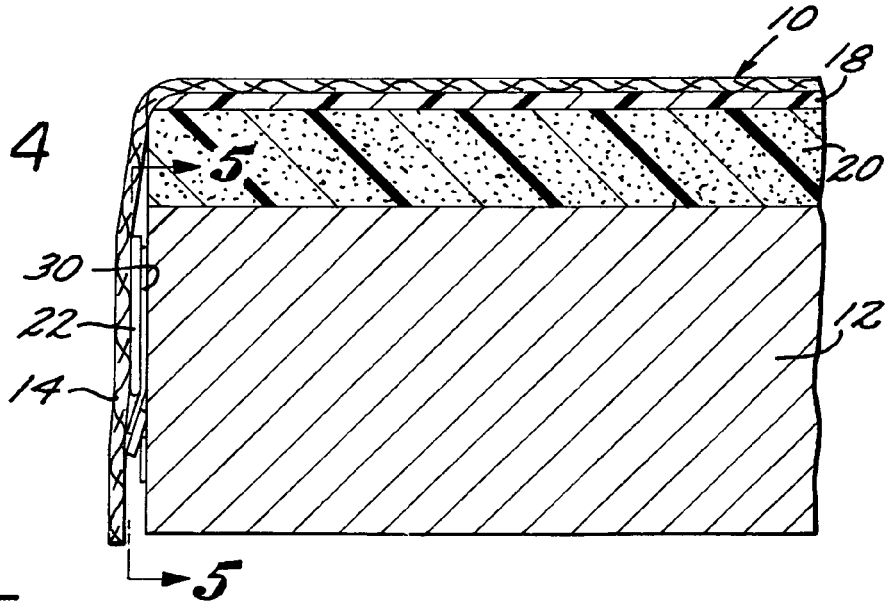
FIG. 4 is a cross-sectional view similar to FIG. 2 with the gaming cloth secured to the table utilizing metal hooks.

The fabric forming cloth 10 is designed to stretch to form the hook/loop engagement as set forth hereinabove. The fit requires a tight, woven fabric. The following fabric compositions have been successfully utilized:

1. 6 ounce micro denier 75/72/2×150/216/2 Polyester 180×80, 60 inch width
2. 5 ounce micro denier 140/200 textured×150/2/96 Polyester 160×80 polyester
3. 160 denier Cordura nylon 160×160 90×60, 60 inch width
4. 330 denier Cordura nylon 330×330 54×38, 60 inch width Referring now to FIG. 4, a second embodiment of the present invention is illustrated. Cloth 10 is identical to the cloth 10 shown in FIGS. 1–3. In this embodiment, the fastener member secured to table 12 comprises a continuous metal strip 30 secured around the perimeter, or circumference, of table 12 as illustrated. Cloth 10 is releaseably attached to table 12 by placing the cloth on the surface of table 12 and then stretching the cloth until the loop members 22 engages metal hooks 34 formed on continuos metal strip 30 in a manner such that he printed image on surface 15 fits the table shape. Excess flap material can be cut off if necessary.

Figure 5:
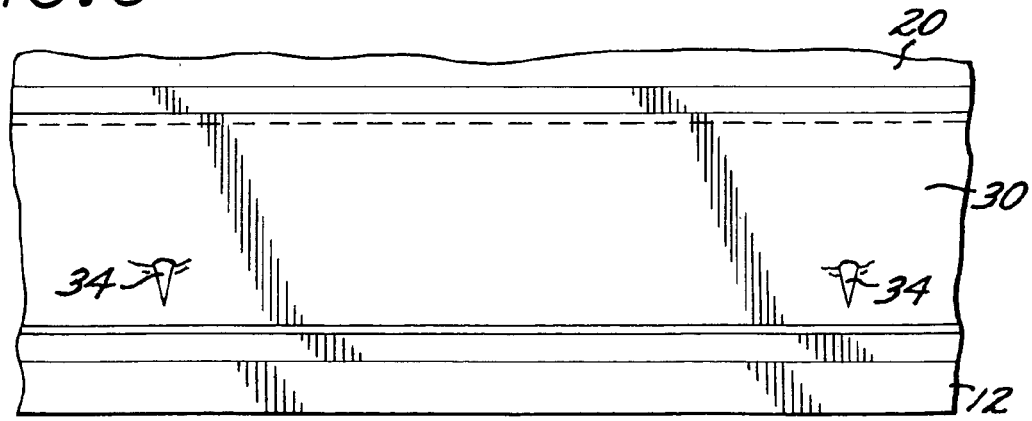
FIG. 5 is a cross-sectional view along line 5—5 of FIG. 4.

FIG. 5 shows in more detail the metal continuous metal strip 30, continuous metal strip 30 having a plurality of protrusions, or hooks, 34 attached thereto.

Although it is preferred that hook strip 24 and continuous metal strip 30 extend around the entire circumference of table 12, the strips can be configured in dimension to extend around a portion of the table circumference. In this case, the flap portions 14 with the loop members 22 formed therein, can be correspondingly reduced in dimension.

The present invention thus provides a simple and inexpensive technique for removably securing a gaming cloth to a gaming table.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed:

1. A gaming table system comprising:

a gaming table cloth having gaming symbols formed on one surface thereof and comprising a tight, woven fabric of a predetermined denier, size and shape, the fabric having a border portion and a first fastening member secured to one surface of said cloth border portion; and a gaming table comprising a surface portion, a portion extending substantially perpendicular from said table surface and around the circumference thereof, and a second fastening member secured around the circumference of said perpendicularly extending table portion, said gaming table cloth being positioned on the surface portion of said table whereby said first fastening member is releasably secured to said second fastening member.

2. The system of claim 1 wherein said first fastening member comprises a hook fastening strip.

3. The system of claim 2 wherein said second fastening member comprises a complimentary loop fastening strip.

4. The gaming table system of claim 1 wherein said border portion comprises a plurality of flap portions extending around the circumference of said cloth, said first fastening member comprising a plurality of fasteners secured to the bottom surface of corresponding flap portions.

* * * * *